United States Patent [19]

Koike et al.

[11] Patent Number: 4,674,423

[45] Date of Patent: Jun. 23, 1987

[54] THREAD LOOP TAKER DEVICE OF A ZIGZAG SEWING MACHINE

[75] Inventors: Mikio Koike; Kenzo Goto, both of Tokyo, Japan

[73] Assignee: Janome Sewing Machine Co., Ltd., Tokyo, Japan

[21] Appl. No.: 919,081

[22] Filed: Oct. 14, 1986

Related U.S. Application Data

[62] Division of Ser. No. 702,875, Feb. 19, 1985.

[30] Foreign Application Priority Data

Feb. 20, 1984 [JP] Japan ..... 59-28689

[51] Int. Cl.[4] ..... D05B 57/08

[52] U.S. Cl. ..... 112/184; 112/230; 112/467

[58] Field of Search ..... 112/181, 182, 184, 228, 112/230, 231, 453, 467

[56] References Cited

U.S. PATENT DOCUMENTS

| | | | |
|---|---|---|---|
| 1,159,523 | 11/1915 | Miller | 112/181 X |
| 2,989,017 | 6/1961 | Taketomi | 112/467 X |
| 4,299,180 | 11/1981 | Kjme et al. | 112/453 X |
| 4,357,887 | 11/1982 | Hara et al. | 112/453 |

FOREIGN PATENT DOCUMENTS

| | | | |
|---|---|---|---|
| 51142933 | 6/1978 | Japan | 112/228 |
| 83/01078 | 3/1983 | PCT Int'l Appl. | 112/184 |

*Primary Examiner*—Wm. Carter Reynolds
*Attorney, Agent, or Firm*—Michael J. Striker

[57] ABSTRACT

A thread loop taker device for a zigzag sewing machine having a needle whose position is controlled by electronically stored data which cooperates with the thread loop taker device to thereby produce zigzag stitches. The thread loop taker device comprises a bobbin carrier, a rotational cylindrical member for supporting the bobbin carrier therein; a loop taker coaxial with and about the cylindrical member for rotation therewith, the loop taker having a beak extending from one end and in the direction of the rotation around a portion of the cylindrical member for catching a thread loop formed by the needle; cams rotating with the cylindrical member and engaging the opposite end of the loop taker for rotating the beak relative to the cylindrical member; and a pulse motor drivable in response to a change in the position of the needle so that, when this driving is transmitted to move the cams, the loop taker is actuated. Thus, the beak rotates relative to the cylindrical member in response to a change in the position of the needle during rotation of the cylindrical member.

4 Claims, 8 Drawing Figures

THREAD LOOP TAKER DEVICE OF A ZIGZAG SEWING MACHINE

This is a division of application Ser. No. 702,875, filed Feb. 19, 1985.

FIELD OF THE INVENTION

This invention relates to a thread loop taker device of a zigzag sewing machine which may produce many kinds of pattern stitchings.

BACKGROUND OF THE INVENTION

In a conventional zigzag sewing machine, it a needle dropping position is different as shown in FIG. 1 as in a left basic line (L), a middle basic line (M) and a right basic line (R), crossing conditions between a needle 1 and a beak 2 of a loop taker are differed respectively, differently from straight stitching sewing machines. If a size of a thread loop of the middle basic line (M) is made proper, the crossing conditions are worst at the remotest needle dropping positions of the left (L) and the right (R). A loop of the upper thread is too large in the left (L), and the loop is too small in the right (R). Thus, the conditions are contrary to each other, and hooking of the thread loop is difficult in each of the needle dropping positions causing skipping or breaking the thread.

In order to improve such crossing conditions, it was proposed to make the vertical movement of the needle slow when hooking the thread loop, or to increase the speed of rotational movement of the loop taker for removing the causes of skipping or breaking of the thread. Unfortunately, such ideas have not been yet commercialized.

SUMMARY OF THE INVENTION

An object of the present invention is to make the loop hooking condition as constant as possible in the zigzag sewing machine, irrespectively of the needle dropping positions, so that zigzag stitchings of large width may be provided without causing skipping or breaking the thread as conventionally happens in large wide zigzag stitchings.

BRIEF DESCRIPTION OF THE DRAWINGS

FIG. 6 is a side view, partially in section, and FIG. 7 is a perspective view of part thereof.

THE MOST PREFERRED EMBODIMENT OF THE INVENTION

A thread loop taker device of a zigzag sewing machine according to the present invention has removed defects of the prior art, and is devised so that it may also work in electronic control sewing machines and pattern cam control sewing machines which memorize data of needles positions for stitching patterns.

Explanations will be made to embodiments of the invention.

Figure 1:
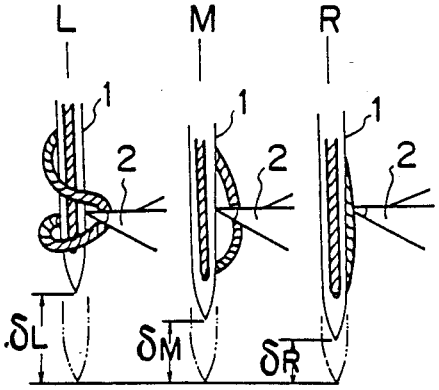
FIG. 1 is views showing crossings of a needle and a beak of a loop taker in the prior art.
Figure 2:
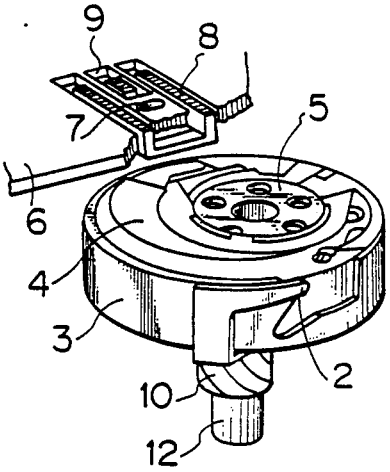
FIGS. 2 and 3 are perspective views of the present invention.
Figure 3:
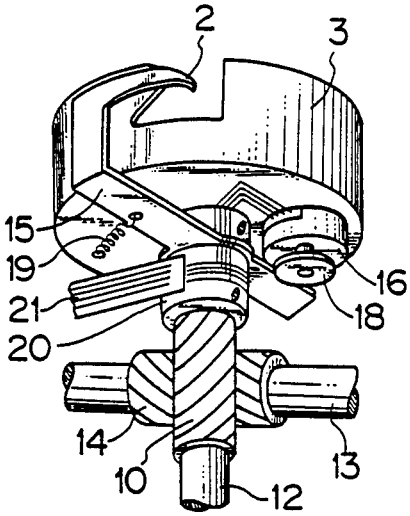

In the attached drawings, a reference numeral 3 designates a race of a full rotation type, and it is arranged with a loop taker 15 having a sharp beak 2 which is positioned at an appropriate place on the outer circumferential wall of the race 3 having a cylindrical shape, and is charged therein with a bobbing carrier 4 which is restrained in rotation and carries a bobbin 5. Above the race 3 and the bobbin carrier 4, a needle plate 6 is furnished, which is detachably secured to a machine frame of a bed of a sewing machine as seen in FIG. 2. The needle plate 6 is defined with a needle drop hole 7 of a large width for passing a needle 1 and openings 9 for raising and dropping feed dogs 8.

Figure 4:
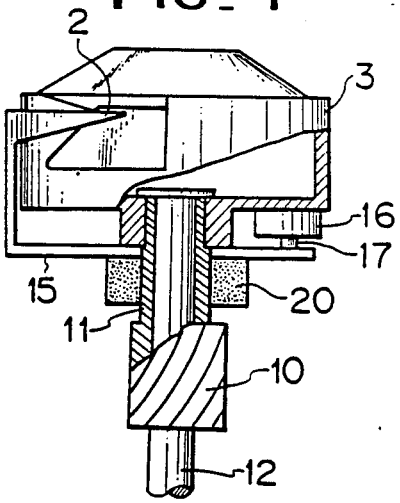
FIG. 4 is a side view, partially in section, of the present invention.
Figure 5:
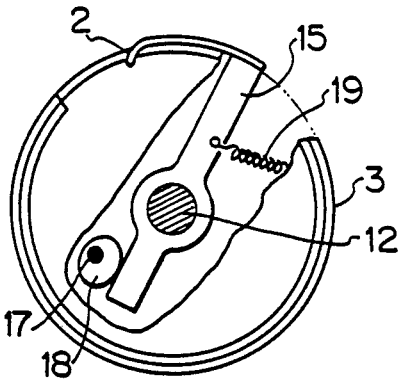
FIG. 5 is a plan view, partially in section, of the present invention.

The race 3 is secured integrally with a hollow shaft 11 which is formed with a screw gear 10 on an rotation axial line (see FIG. 4). A numeral 12 designates a shaft which rotatably holds the race 3, and the screw gear 10 is in mesh with a screw gear 14 firmly mounted on a drive shaft 13 and which is driven by a motor (not shown).

The beak 2 is formed at the end portion of a perpendicular part bent upwardly of the loop taker 15 which is rotatably pivoted on the shaft 12 of the race 3. The loop taker 15 has a spring 19 at its appropriate part. The other end of the spring 19 is attached to race 3. A cam plate 18 is mounted on a rotation shaft 17 of a driving element 16 such as a pulse motor which is provided on the lower surface of the bottom of the race 3.

The numeral 20 designates a non-conductive cylindrical body which is secured on the hollow shaft 11 as one body with the race 3, and its outer circumference is provided with a plurality of conductive members, each of which is connected to a magnetic field coil and to a power source brush 21.

Figure 6:
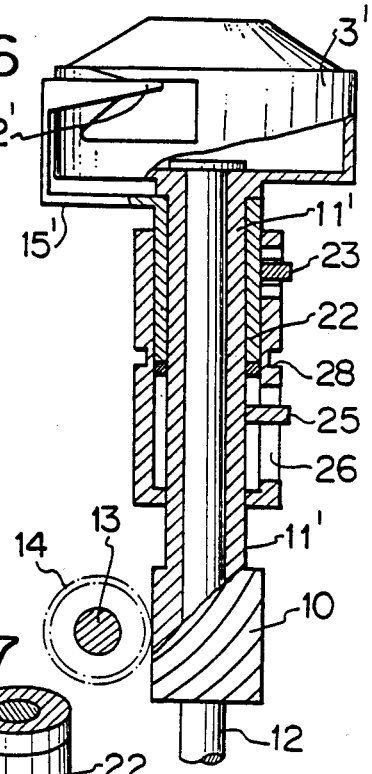
FIGS. 6 and 7 are a second embodiment of the present invention.
Figure 7:
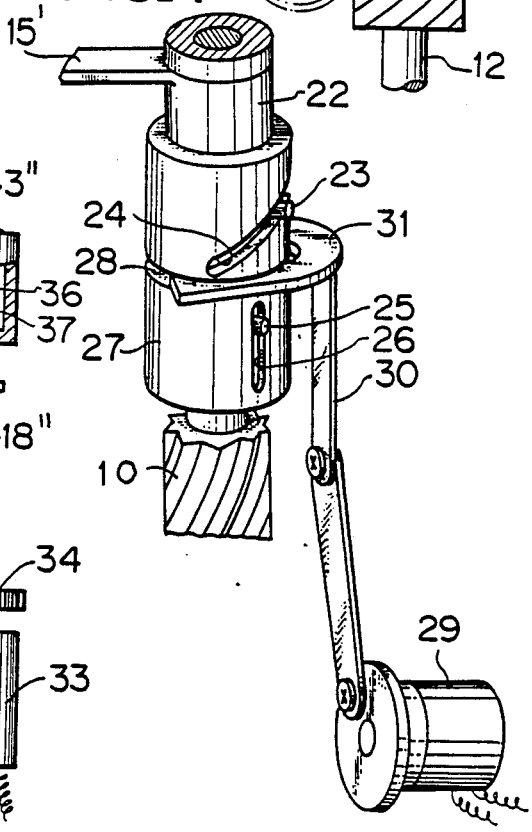

The second embodiment of the invention appearing in FIGS. 6 and 7 is provided with a cylindrical shaft 22 which is engaged with the hollow shaft 11' of the race 3' and is rotatable therearound. A pin 23 is implanted on the shaft 22. The cylindrical shaft 22 has a collar 27 mounted thereon and being slidable therealong. The collar is formed with an oblique groove 24 to be in engagement with the pin 23 and is further formed with a guide groove 26 to be in engagement with a pin 25 projecting from the hollow shaft 11'. The collar 27 is further formed with a groove 28 circumferentially thereof to be in engagement with a fork 31 connected to one end of an articulated lever 30, the other end of which is connected to a driving element 29 such as a pulse motor positioned at an appropriate part of the machine frame.

Figure 8:
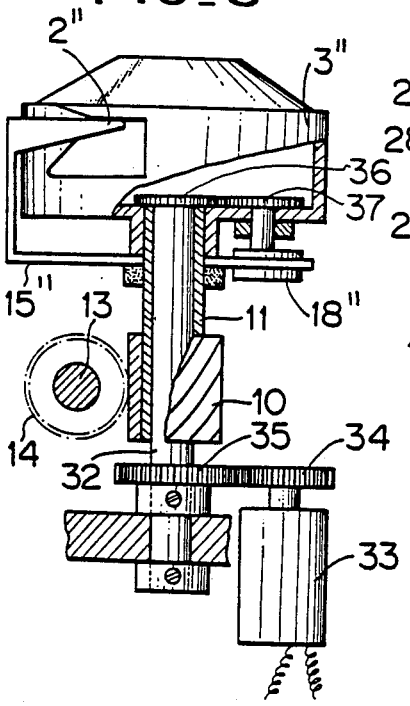
FIG. 8 is a side view, partially in section, of a third embodiment of the present invention.

A third embodiment of the invention is shown in FIG. 8. A shaft 32 supports the race 3'', and is driven by a driving element 33 such as a pulse motor via gears 34, 35. The race 3'' is provided with a gear 36 therewithin for meshing with a gear 37 on which a cam plate 18'' is provided coaxially, and the cam plate 18'' is pressed by the loop taker 15'' with its end portion. The driving elements 29, 33 may be substituted by cam members to be rotated.

The device of the invention is composed as mentioned above. When the sewing machine is driven to move the needle vertically and simultaneously the race is rotated, needle amplitude data of pattern stitching are taken out from a data memory and the needle is moved laterally to produce patterns. At this time, said needle amplitude data are input into the driving element 16, 29 or 33 to be driven by angular amounts required respectively.

The rotation of said driving elements alters relative positions in a rotating direction between the loop taker 15, 15', 15'' and the race 3, 3', 3'' during rotation of the race 3, 3', 3'' in order to alter phases of the loop taker 15, 15', 15'' via rotation of the cam plate 18'' or movement of the oblique groove 24, so that the beak 2 crosses with the needle 1 at time when the needle 1 moves upwardly by δM under the same condition as the needle crossing in a middle basic line (M), though in a left basic line (L) and a right basic line (R).

With respect to the crossing condition of the needle and the beak, the loop taker is moved forward or backward relatively with the race via the driving element by the pattern stitching needle amplitude data taken out from the data memory. The beak 2, 2', 2'' crosses with the needle by the same amount δ of the needle rising as the amount δM of the middle basic line (M) even if it is in any position, and therefore the thread loop may be exactly caught without skipping or breaking the thread.

What is claimed is:

1. A thread loop taker device for a zigzag sewing machine having a vertically movable needle which forms a thread loop thereunder, the device comprising:

a bobbin carrier;

a rotatable race for non-rotatably holding said bobbin carrier;

a loop taker having an end portion shaped as a beak and being rotatable together with said race and being rotatable relative to said race into a plurality of positions relative to said race; and driving means for rotating said end portion through at least one of said positions in response to a change in the positon of the needle so that said end portion hooks the thread loop, said driving means including a hollow shaft having a first pin projecting perpendicularly therefrom, a cylindrical shaft concentric to said hollow shaft and having a second pin projecting perpendicularly therefrom, and a slide collar mounted concentric to said hollow shaft and said cylindrical shaft and having an oblong groove and an oblique groove cooperating with said first pin and said second pin respectively.

2. A thread loop taker device for a zigzag sewing machine that includes a needle variably positioned by electronically stored data that cooperates with the thread loop taker device so as to produce zigzag stitches, said loop taker device comprising:

a bobbin carrier;

a rotational cylindrical member for supporting said bobbin carrier therein;

a loop taker coaxial with and mounted outside said cylindrical member for rotation therewith, said loop taker having one end and an opposite end and also having a beak extending from said one end and in a direction of said rotation around a portion of said cylindrical member for catching a thread loop formed by the needle;

cam means engaging said opposite end of said loop taker for rotating said beak relative to said cylindrical member; means for actuating said loop taker, including a pulse motor drivable in response to a change in the position of the needle; and means for transmitting said driving of said pulse motor to move said cam means so that said beak rotates relative to said cylindrical member in response to a change in the position of the needle during rotation of said cylindrical member.

3. The thread loop taker device as defined in claim 2, wherein said cylindrical member has an outside surface, said cam means mounted on said outside surface, and said transmission means located between said pulse motor and same cam means.

4. The thread loop taker device as defined in claim 3; further comprising:

a sleeve coaxial with and axially movable relative to said loop taker, said cam means including a groove cam formed on said sleeve, a pin provided on said opposite end of said loop taker, said groove cam cooperating with said pin, said transmitting means including a lever having one end operatively connected to said pulse motor and a forked end opposite said one end, said forked end being operatively connected to said sleeve.

* * * * *